US005381717A

United States Patent [19]

Brokaw

[11] Patent Number: 5,381,717

[45] Date of Patent: Jan. 17, 1995

[54] STRING INSTRUMENT WORK TABLE

[76] Inventor: Gary L. Brokaw, 456 Croton Ave., Cortlandt Manor, N.Y. 10566

[21] Appl. No.: 138,728

[22] Filed: Oct. 20, 1993

[51] Int. Cl.[6] ..... G10D 3/00; A47G 1/24; A47B 23/00

[52] U.S. Cl. ..... 84/327; 84/453; 108/43; 248/455

[58] Field of Search ..... 84/327, 453; 108/1, 108/43, 91, 92, 93, 50; 248/455, 465, 371

[56] References Cited

U.S. PATENT DOCUMENTS 1,772,308 8/1930 Ezzelle ..... 84/327

4,235,472 11/1980 Sparks et al. ..... 108/43

*Primary Examiner*—Michael L. Gellner
*Assistant Examiner*—Cassandra C. Spyron
*Attorney, Agent, or Firm*—E. Michael Combs

[57] ABSTRACT

A table including a top wall having a foam cushion insert extending from a first end of the table to a second end of the table in a spaced relationship, such that a handle is directed through the table, with a foam cushion block mounted between the handle extending onto the insert to position a string instrument neck thereon. Securement strap structure is provided to secure the instrument onto the table during use.

4 Claims, 4 Drawing Sheets

STRING INSTRUMENT WORK TABLE

BACKGROUND OF THE INVENTION

1. Field of the Invention

The field of invention relates to work table structure, and more particularly pertains to a new and improved string instrument work table wherein the same is directed for the mounting and positioning of a string instrument during its support for working thereon.

2. Description of the Prior Art

Work table structure of various types is indicated in the prior art, with the U.S. Pat. Nos. 4,102,555; 3,669,031; and 3,923,356 arranged to provide examples of various work table support structure.

The instant invention is directed to overcome deficiencies of the prior art by providing for a table structure specifically directed to the positioning and mounting of string instruments thereon for the support during their repair and maintenance and in this respect, the present invention substantially fulfills this need.

SUMMARY OF THE INVENTION

In view of the foregoing disadvantages inherent in the known types of work table structure now present in the prior art, the present invention provides a string instrument work table wherein the same includes a cushion top wall for positioning a string instrument thereon. As such, the general purpose of the present invention, which will be described subsequently in greater detail, is to provide a new and improved string instrument work table which has all the advantages of the prior art work table structure and none of the disadvantages.

To attain this, the present invention provides a table including a top wall having a foam cushion insert extending from a first end of the table to a second end of the table in a spaced relationship, such that a handle is directed through the table, with a foam cushion block mounted between the handle extending onto the insert to position a string instrument neck thereon. Securement strap structure is provided to secure the instrument onto the table during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved string instrument work table which has all the advantages of the prior art work table structure and none of the disadvantages.

It is another object of the present invention to provide a new and improved string instrument work table which may be easily and efficiently manufactured and marketed.

It is a further object of the present invention to provide a new and improved string instrument work table which is of a durable and reliable construction.

An even further object of the present invention is to provide a new and improved string instrument work table which is susceptible of a low cost of manufacture with regard to both materials and labor, and which accordingly is then susceptible of low prices of sale to the consuming public, thereby making such string instrument work tables economically available to the buying public.

Still yet another object of the present invention is to provide a new and improved string instrument work table which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
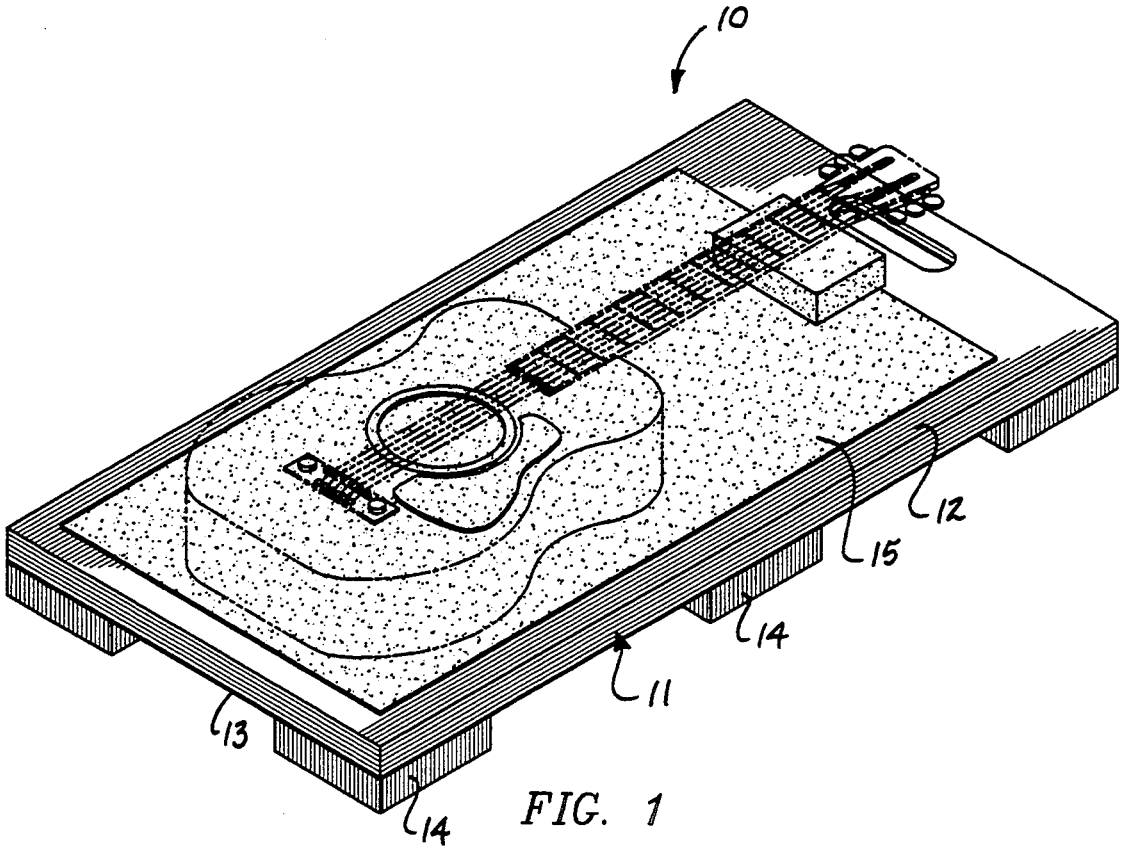
FIG. 1 is an isometric illustration of the invention indicating a string instrument thereon.
Figure 2:
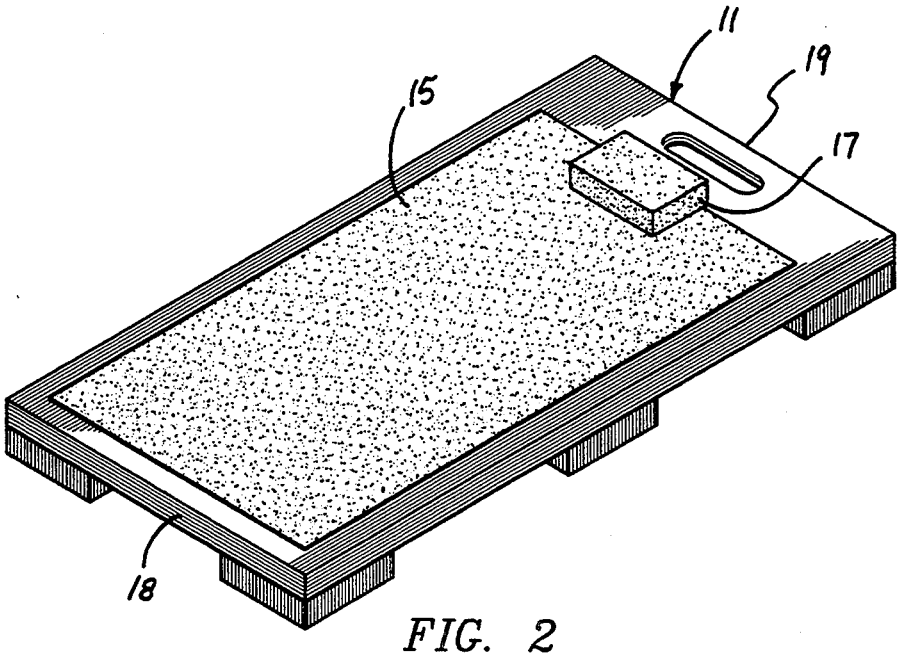
FIG. 2 is an isometric illustration of the work table structure.
Figure 3:
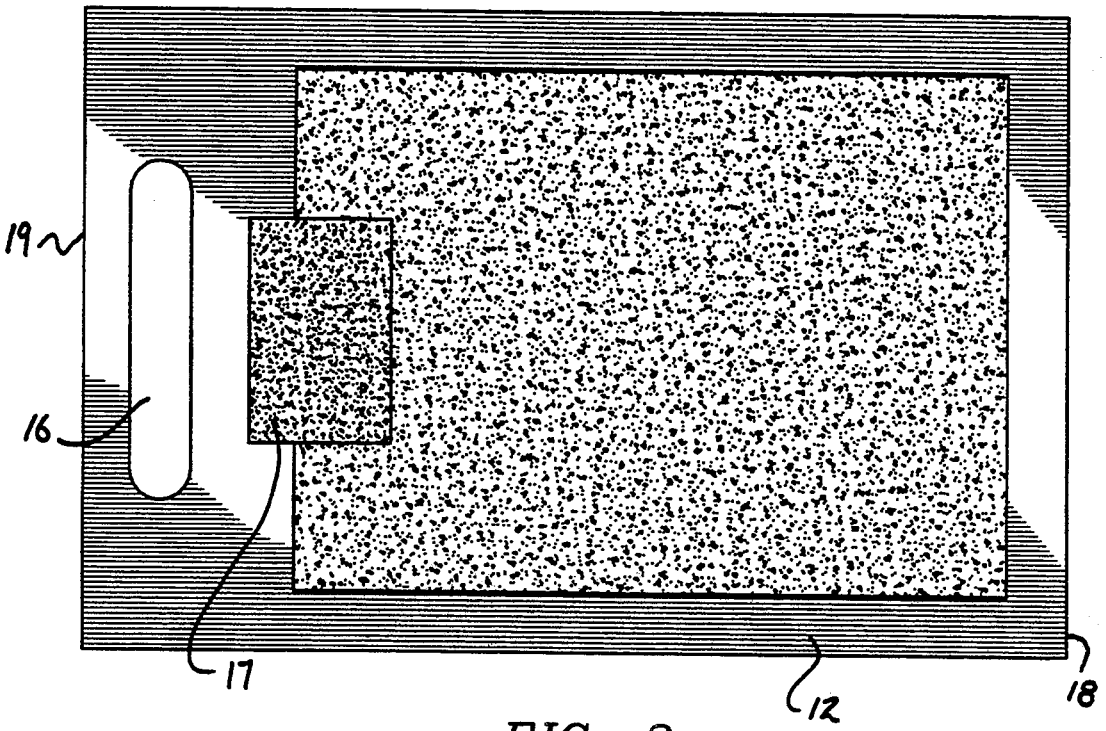
FIG. 3 is an orthographic top view of the work table.
Figure 4:
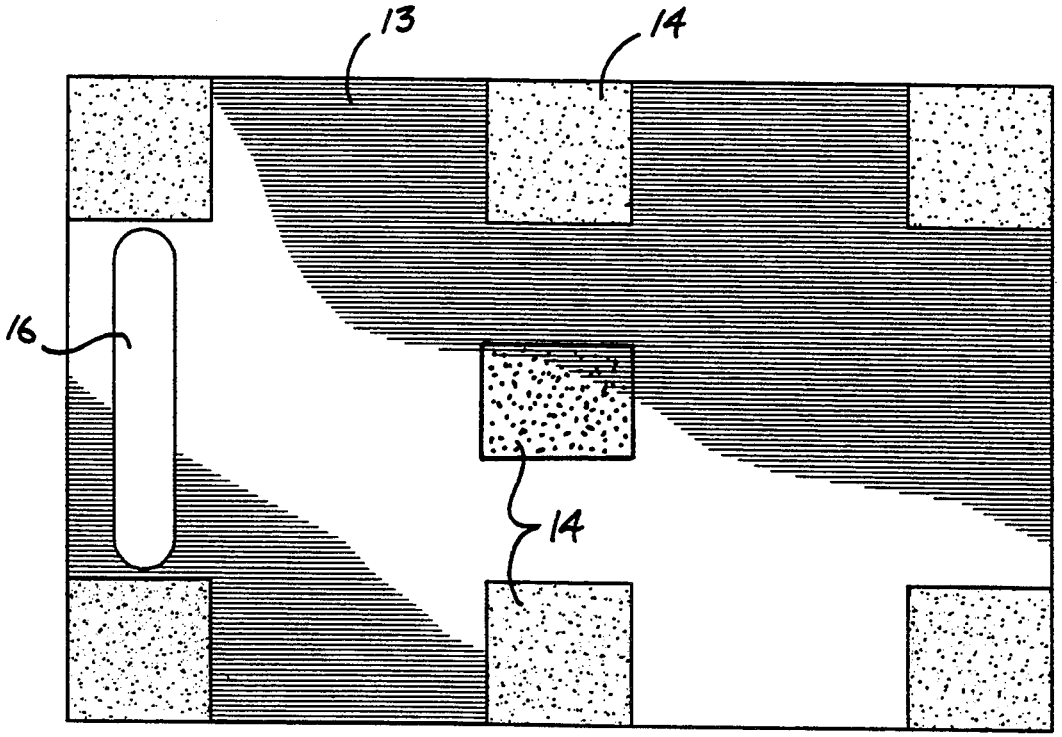
FIG. 4 is an orthographic bottom view of the work table.
Figure 5:
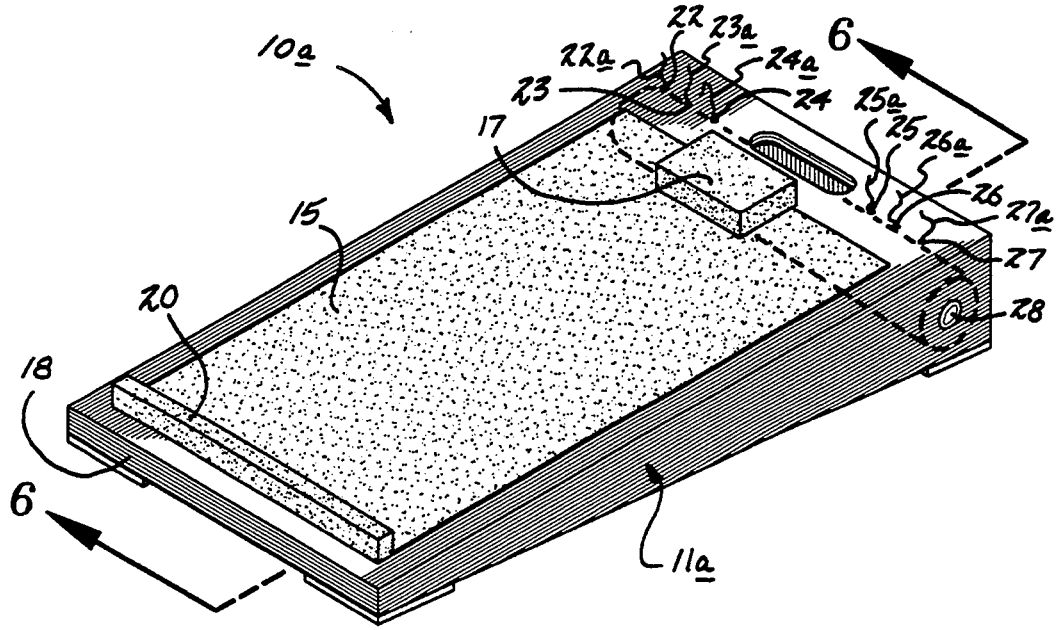
FIG. 5 is an isometric illustration of a modified work table structure.
Figure 6:
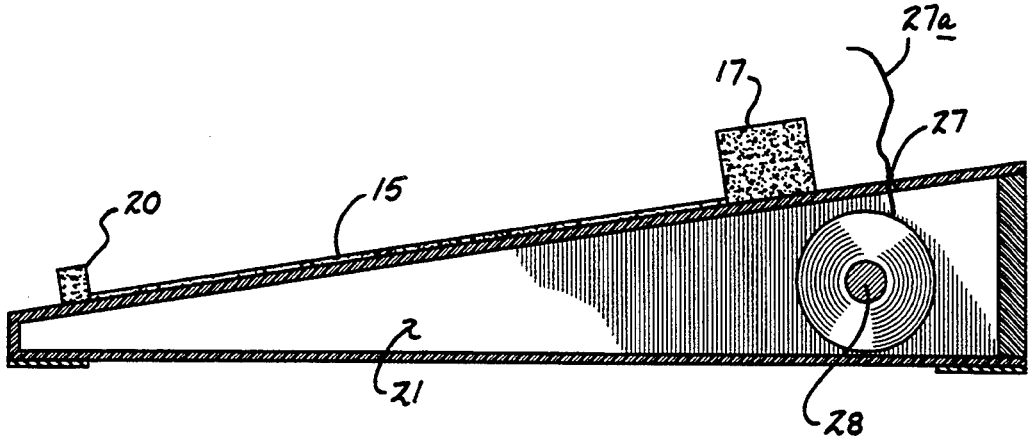
FIG. 6 is an orthographic view, taken along the lines 6—6 of FIG. 5 in the direction indicated by the arrows.
Figure 7:
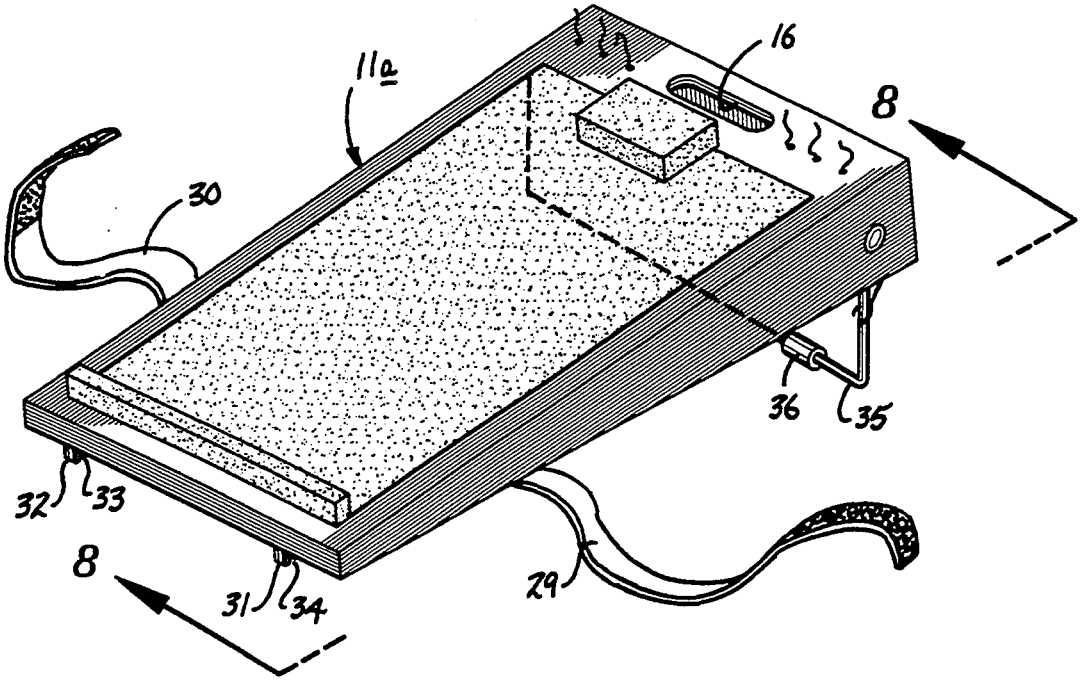
FIG. 7 is an isometric illustration of the work table to further include securement straps and adjustable leg structure.

With reference now to the drawings, and in particular to FIGS. 1 to 8 thereof, a new and improved string instrument work table embodying the principles and concepts of the present invention and generally designated by the reference numerals 10 and 10*a* will be described.

More specifically, the string instrument work table 10 of the instant invention essentially comprises a rigid platform 11, having a top wall 12 spaced from a bottom wall 13, as well as a first end 18 spaced from a second end 19. Support legs 14 are mounted to the bottom wall, 13 about the periphery to include one medially of the bottom wall, such as indicated in the FIG. 4, for support of the platform structure. A handle opening 16 is directed through the platform in adjacency to the second end 19, with a foam cushion insert 15 mounted into the top wall 12 extending from the handle in spaced adjacency to the first end 18.

A cushion block 17 is mounted onto the cushion insert extending from the cushion insert between the cushion insert and the handle opening 16. A string instrument is arranged for mounting upon the cushion insert 15, with its neck portion supported by the cushion block 17 for working upon the structure. In this manner, the platform may be mounted upon an underlying support surface as desired.

The FIGS. 5–8 indicate a modified work table 10*a* to include a platform housing 11*a*, having a housing cavity 21. An abutment rib 20 is mounted onto the top wall between the first end 18, with the cushioned abutment rib 20 in contiguous and coextensive relationship with the cushion insert 15 in adjacency to the first end 18 and the second end 19. First, second, third, fourth, fifth, and sixth feed apertures 22, 23, 24, 25, 26, and 27 are directed into the platform 11*a* through the top wall 12 into communication with the cavity 21, where an axle 28 mounts a roll of various strings to include first, second, third, fourth, fifth, and sixth strings 22*a*, 23*a*, 24*a*, 25*a*, 26*a*, and 27*a* directed respectively through the first through sixth feed apertures 22–27. In this manner, various strings relative to various frequency of replacement upon the string instrument are provided for convenience and use and are positioned through the top wall in adjacency to the handle opening on opposed sides thereof for convenience, thereby the neck is directed on the support block between the third and fourth apertures feeding the third and fourth strings.

Figure 8:
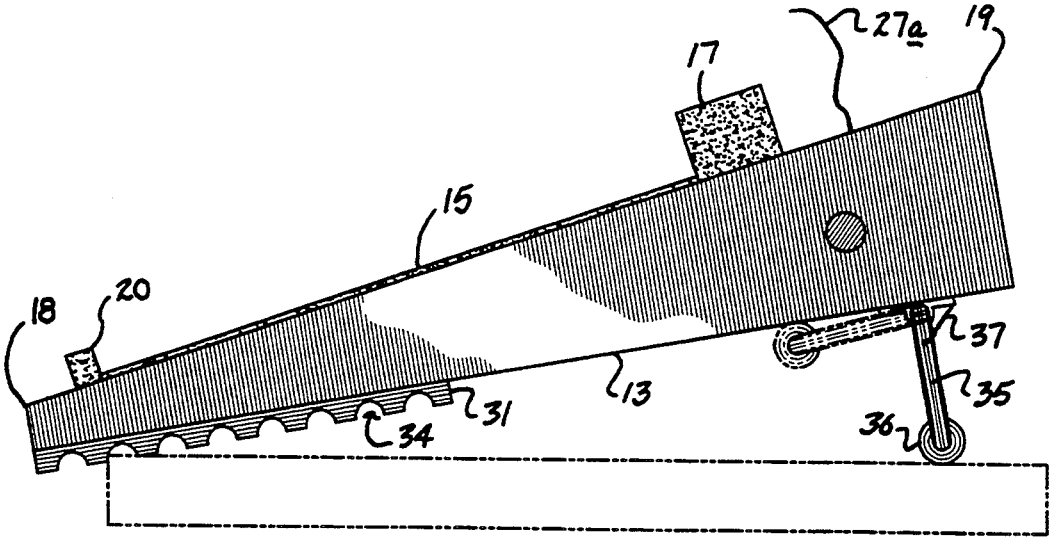
FIG. 8 is an orthographic side view of the invention, taken along the lines 8—8 of FIG. 7 in the direction indicated by the arrows.

Further, first and second straps 29 and 30 are mounted to the respective first and second sides of the platform housing, having respective first and second hook and loop fasteners mounted to the first and second straps for securement about the body of the string instrument for its securement upon the cushion insert. In lieu of the support legs 14, first and second support legs 31 and 32 parallel relative to one another fixed coextensively of their length to the bottom wall are orthogonally oriented relative to the first end 18, and include rows of respective first and second recesses 33 and 34, with each first recess 33 aligned with each second recess 34 to thereby provide for abutment in receiving and capturing an edge portion of a support table, in a manner as indicated in FIG. 8. A support loop 35 pivotally mounted to the bottom wall includes at least one roller 36 to provide for ease of orientation of the support loop 35 orthogonally relative to the bottom wall. The abutment rib 37 is provided to capture and receive the support loop 35 preventing over-centering of the support loop 35 and its orienting at ninety degrees relative to the bottom wall. In this manner, ease of operation upon a string instrument is provided and accordingly, the manner of use and operation of the instant invention should be apparent from the above disclosure and accordingly no further discussion relative to the manner of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A string instrument work table, comprising, a rigid platform, having a top wall spaced from a bottom wall, and a first end spaced from a second end, with a first side spaced from a second side, and the top wall including a foam cushion insert mounted to the top wall extending from the first end in a spaced relationship relative to the second end, with a handle opening directed through the top wall between the foam cushion insert and the second end, and a foam cushion block mounted onto the foam cushion insert extending from the foam cushion insert in a spaced relationship relative to the handle opening, with the handle opening and the foam cushion block oriented medially between the first side and the second side.

2. A work table as set forth in claim 1 including a cushion abutment rib mounted to the foam cushion insert adjacent the first end, and a first strap secured to the first side and a second strap secured to the second side, with the first strap having a first hook and loop fastener member, and the second strap having a second hook and loop fastener member permitting securement of the first strap to the second strap about a string instrument.

3. A work table as set forth in claim 2 wherein the platform includes a housing cavity oriented between the top wall and the bottom wall, and at least one feed aperture directed through the top wall into communication with the cavity between the handle opening and the second side, and a second feed aperture directed through the top wall in communication with the cavity between the handle opening and the first side, and an axle rotatably mounted within the cavity between the first side and the second side, and the axle including a first string secured thereabout directed through the first aperture, and a second string secured about the axle directed through the second feed aperture.

4. A work table as set forth in claim 3 including a first support leg and a second support leg, with each integrally mounted to the bottom wall coextensively, with the first support leg and the second support leg orthogonally oriented relative to the first end, and the first support leg having first recesses, the second support leg having second recesses, with each of said first recesses aligned with one of said second recesses, and a support loop pivotally mounted to the bottom wall adjacent the second end, and the support loop including at least one roller mounted about the support loop, with the support loop pivotal from a first position with the roller abutment with the bottom wall to a second position, wherein the support loop is orthogonally oriented relative to the bottom wall, and an abutment pin mounted to the bottom wall to orient the support loop in the second position.

* * * * *